US009506271B2

(12) United States Patent
Vreeland

(10) Patent No.: US 9,506,271 B2
(45) Date of Patent: Nov. 29, 2016

(54) APPARATUS FOR INSTALLING A SILT FENCE

(71) Applicant: Gregory M. Vreeland, Springboro, OH (US)

(72) Inventor: Gregory M. Vreeland, Springboro, OH (US)

( * ) Notice: Subject to any disclaimer, the term of this patent is extended or adjusted under 35 U.S.C. 154(b) by 0 days.

(21) Appl. No.: 14/689,969

(22) Filed: Apr. 17, 2015

(65) Prior Publication Data

US 2016/0305153 A1 Oct. 20, 2016

(51) Int. Cl.

| | |
|---|---|
| ***E02F 5/10*** | (2006.01) |
| ***E02D 17/20*** | (2006.01) |
| ***E04H 17/26*** | (2006.01) |
| ***E02F 5/02*** | (2006.01) |
| ***E04H 17/04*** | (2006.01) |

(52) U.S. Cl.

CPC ..... *E04H 17/26* (2013.01); *E02D 17/202* (2013.01); *E02F 5/027* (2013.01); *E04H 17/04* (2013.01); *E02F 5/101* (2013.01)

(58) Field of Classification Search

CPC ..... E02D 17/02; E02F 5/101; E02B 7/02
See application file for complete search history.

(56) References Cited

U.S. PATENT DOCUMENTS

| | | | | |
|---|---|---|---|---|
| 5,915,878 | A * | 6/1999 | Carpenter | E02F 5/08 405/270 |
| 6,053,665 | A * | 4/2000 | Richardson | E01F 7/04 256/12.5 |
| 6,158,923 | A * | 12/2000 | Wheeler | E04H 17/261 256/12.5 |
| 6,398,459 | B1 * | 6/2002 | Vreeland | E02D 17/202 37/367 |
| 6,517,294 | B2 | 2/2003 | Vreeland | |
| 6,796,747 | B1 * | 9/2004 | Vreeland | E02D 17/202 173/184 |
| D504,134 | S * | 4/2005 | McCormick | D15/10 |
| 6,945,739 | B1 * | 9/2005 | Putman | E02D 19/18 405/15 |
| 7,296,636 | B1 * | 11/2007 | Vreeland | E04H 17/263 173/184 |
| 7,762,745 | B1 * | 7/2010 | Burchland | E02D 17/20 172/720 |
| 2002/0192029 | A1 * | 12/2002 | Vreeland | E02D 17/202 405/116 |
| 2006/0056917 | A1 * | 3/2006 | McCormick | E02F 5/101 405/116 |
| 2009/0110493 | A1 * | 4/2009 | Rorabaugh | E02F 5/10 405/302.6 |
| 2009/0304460 | A1 * | 12/2009 | O'Dell | E02F 5/027 405/302.7 |

* cited by examiner

*Primary Examiner* — Frederick L Lagman
(74) *Attorney, Agent, or Firm* — Jacox, Meckstroth & Jenkins

(57) ABSTRACT

A frame is supported for vertical movement by a vehicle and has an inclined shaft supporting a roll of silt fence material. The frame also supports a vertical plow plate having a forward edge surface and an inclined rearward edge surface spaced adjacent an inclined foldover member to define a narrow gap which receives fence material directly from the roll. The plow supports a removable, flexible and resilient panel which projects rearwardly to extend within a slit formed in the ground by the plow plate to prevent debris from snagging the material. The inclined shaft is adjustable vertically, and the roll is adjustable axially on the shaft to maintain an edge of the fence material adjacent the bottom of the plow plate. The frame may also support a rotatable and vertically movable boom from which depends an impact hammer for installing stakes in the ground adjacent the fence.

18 Claims, 4 Drawing Sheets

APPARATUS FOR INSTALLING A SILT FENCE

BACKGROUND OF THE INVENTION

The present invention relates to a machine or apparatus for installing a longitudinal edge portion of a flexible silt fence material or geotextile into a slit formed within the ground. Such apparatus is disclosed in U.S. Pat. No. 6,398,459, U.S. Pat. No. 6,517,294, U.S. Pat. No. 6,796,747, and U.S. Pat. No. 7,296,636 which issued to applicant of the present invention and the disclosures of which are herein incorporated by reference. In general, the apparatus includes a fabricated metal frame which is supported for vertical movement usually by a three point hitch on the back of a tractor or on the front end of a bucket loading vehicle after the bucket is removed. The plow plate has a forward edge surface for cutting a slit into the ground as the apparatus moves forwardly and a rearward edge surface which cooperates with a rigid panel to define a narrow uniform gap for receiving the fence material and directing a lower edge portion of the material into the slit formed within the ground.

As disclosed in the above patents, the roll of silt fence material is supported by a horizontal shaft which may be shifted horizontally and laterally so that the fence material extending from the roll is close to a horizontal foldover member or tube from which a portion of the fence material is directed into the gap defined between the plow plate and the adjacent rigid panel. As also disclosed in the '747 Patent and the '636 Patent, the frame may also support an adjustable boom which is rotated on a vertical mast and supports a depending impact hammer for driving stakes in the ground adjacent the fence.

As shown in the above patents, it is desirable to position the plow plate close to the rear wheels of a tractor supporting the apparatus to reduce the turning radius of the tractor and apparatus. It is also desirable to position the plow plate behind a rear wheel of the tractor so that the tractor and apparatus may install the silt fence close to a tree line bordering an area which requires the silt fence. In order to provide for reducing the turning radius of the tractor supporting the apparatus, it is known to provide a hinge connection of the plow plate to the hitch on the tractor and to support the rigid panel following the plow plate for pivotal movement relative to the plow plate, for example, as disclosed in U.S. Pat. No. 7,044,689, U.S. Pat. No. 7,144,202 and Design Pat. No. 504,134. However, this form of connecting the silt fence installing machine or apparatus to the supporting vehicle adds significantly to the cost of the silt fence installing apparatus.

SUMMARY OF THE INVENTION

The present invention is directed to an improved machine or apparatus for installing a silt fence material as disclosed in the above patents issued to applicant and which provides additional desirable features and advantages. That is, the apparatus of the invention provides more reliable feeding of the material into the ground, eliminating the need for a folded flap in the material and thus uses less material, reduces the cost of constructing the apparatus, extends the service life of the apparatus, and allows for a tight turning radius of the apparatus with the supporting vehicle without the use of a pivot system in front of the plow. The apparatus also reduces the maintenance required for servicing the apparatus, for mounting an efficient stake driver, for conveniently installing a roll of silt fence material, and for adjusting the position of the roll so that an edge portion of the silt fence material tracks near the bottom of the plow plate and the bottom of the slit formed within the ground by the plow plate.

In general, a preferred form of the apparatus of the invention includes a fabricated metal frame supporting a shaft having an inclined axis and supporting the core of a supply roll of the fence material. The frame also supports a plow plate having a forward edge surface and an inclined rearward edge surface. The frame and bottom portion of the plow plate support opposite end portions of an inclined foldover member or bar positioned parallel and adjacent the rearward edge surface of the plow plate to define a narrow gap. The gap receives the silt fence material extending from the supply roll, and the material folds around the foldover bar with an edge portion of the material extending into a slit formed in the ground by the plow plate in response to forward movement of the apparatus with the pulling vehicle. A flexible and resilient protector panel or member is connected to the plow plate and projects rearwardly within the slit in the ground adjacent the embedded portion of the silt fence material. The shaft supporting the supply roll extends in a plane preferably parallel to the vertical plow plate, and is inclined at an angle within a range of about 40 to 50 degrees. The foldover member or bar and the gap extend at an angle of about one half of the angle of the shaft or within a range of about 20 degrees and 25 degrees.

Other features and advantages of the invention will be apparent from the following description, the accompanying drawings and the appended claims.

DESCRIPTION OF THE ILLUSTRATED PREFERRED EMBODIMENT

Figure 1:
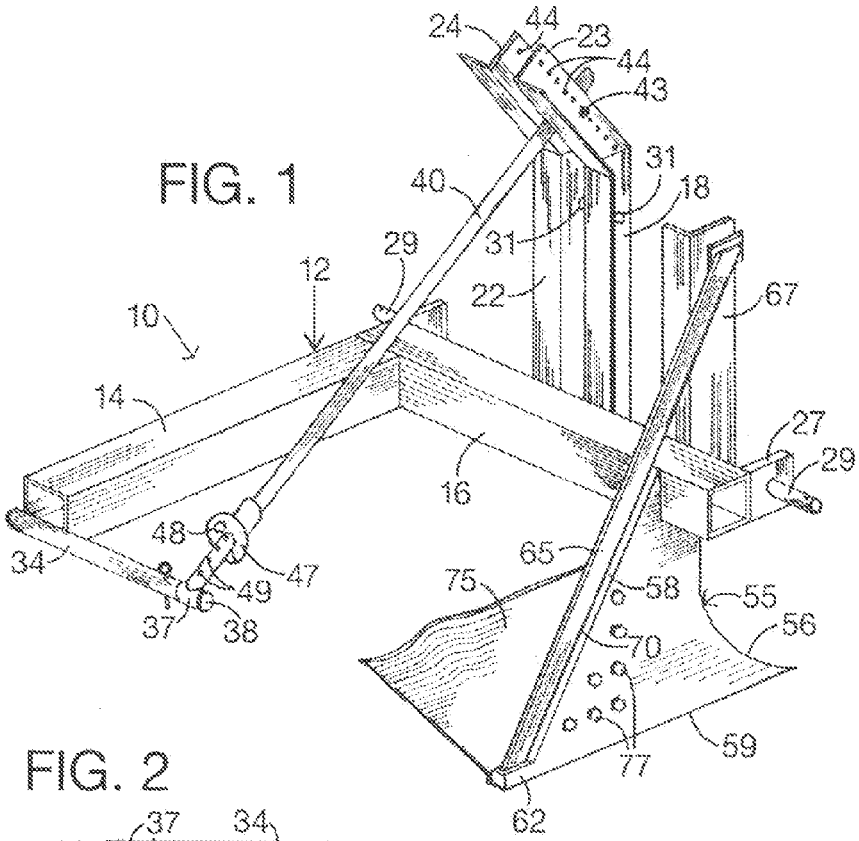
FIG. 1 is a perspective view of silt fence inserting apparatus constructed in accordance with the invention.

FIG. 1 illustrates a machine or apparatus 10 for inserting a flexible silt fence material F such as a geotextile material, into a slit formed within the ground and which is adapted to be used on a machine or apparatus as disclosed in above-mentioned U.S. Pat. No. 6,796,747. The apparatus of the invention includes a fabricated metal or steel frame 12 preferably formed with square tubular steel horizontal members 14 and 16 welded together with the laterally extending frame member 16 supporting the lower end portions of vertical right angle frame members 18 and 22 having corresponding inclined upper end portions 23 and 24. The opposite end portions of the frame member 16 support forwardly projecting brackets or plates 27 (FIGS. 1 & 2) which support laterally outwardly projecting and aligned horizontal pivot pins 29. The vertical frame members 18 and 22 have horizontally aligned holes 31, and the pivot pins 29 and holes 31 form pivot connections with the arms (not shown) of a three point hitch system projecting rearwardly from a tractor for supporting and lifting the frame 12 in a generally vertical direction.

The rearwardly projecting horizontal frame member 14 has a rearward end portion supporting a laterally and inwardly projecting horizontal arm or tubular frame member 34 which supports a rotatable fitting 37 mounted on a stub shaft 38 projecting into the member 34. The fitting 37 is welded to the lower end of an inclined shaft 40 which supports a roll R of flexible silt fence material F with the material commonly wound on a tubular core (not shown). The upper portion of the shaft 40 is supported between the inclined end portions 23 and 24 of the frame members 18 and 22 and rests on a cross pin 43 extending through a selected pair of aligned holes 44 within the support members 23 and 24. The axis A (FIG. 3) of the inclined shaft 40 extends on an angle A1 preferably within a range of about 40 degrees and 50 degrees such as an angle of about 45 degrees. The lower end portion of the shaft 40 carries an annular disk or plate 47 for engaging the lower end of the tubular core for the roll R. The plate 47 is adjustable axially on the shaft 40 by positioning a cross pin 48 (FIG. 1) within a pair of selected aligned cross holes 49 formed within the lower end portion of the shaft 40.

Figure 3:
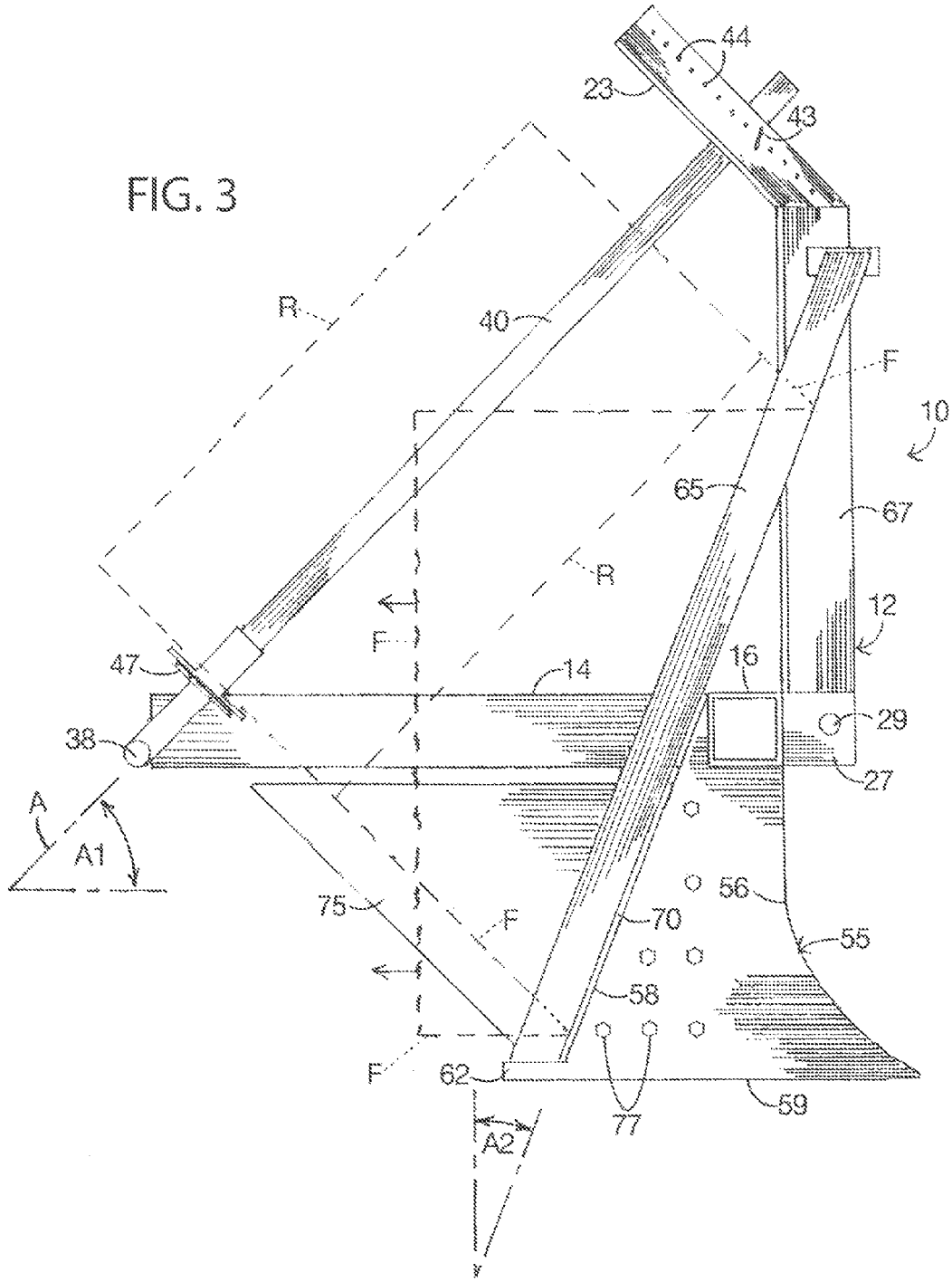
FIG. 3 is a side elevational view of the apparatus shown in FIG. 1 and showing the supply roll of fence material and its path through the apparatus by dotted lines.

Referring to FIGS. 1 and 3, a flat vertical metal or steel plow plate 55 has an upper portion welded to the cross frame member 16 and also has a forward edge plowing surface 56 and an inclined linear rearward edge surface 58 and a straight horizontal bottom edge surface 59. Preferably, the forward edge surface 56 of the plow plate 55 is curved downwardly and forwardly, but the surface may have other shapes. The plow plate 55 has a rearwardly projecting bottom portion 62 which supports the lower end of an inclined foldover member or bar 65 which has an upper end portion supported by and secured to a vertical angle member 67 forming part of the frame 12.

Figure 2:
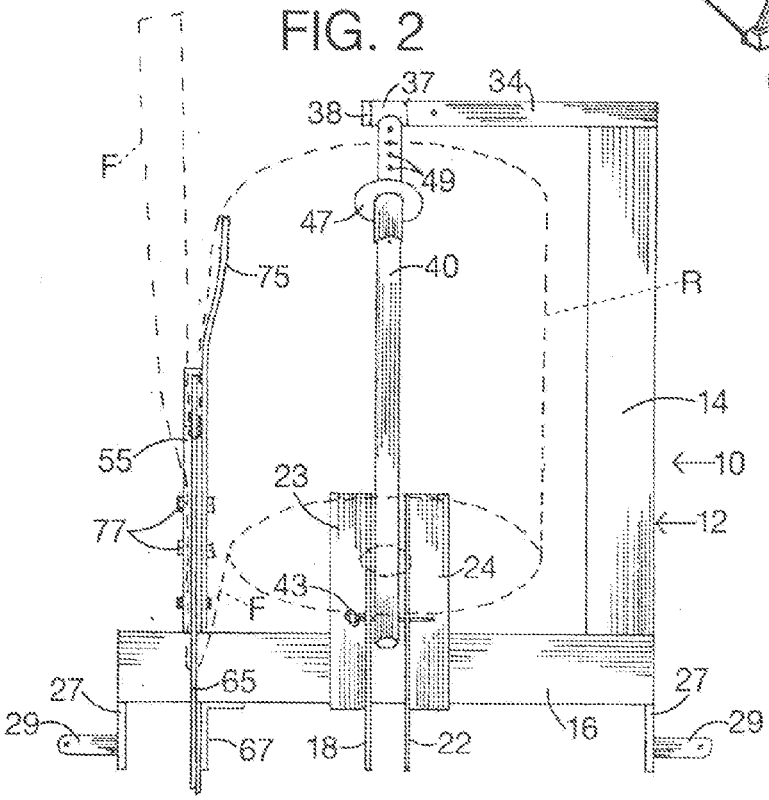
FIG. 2 is a top plan view of the apparatus shown in FIG. 1 and with a roll of silt fence material shown by dotted lines.

The straight rearward edge surface 58 of the plow plate 55 and the opposing foldover bar 65 define therebetween a uniform inclined narrow gap 70. The rearward edge surface 58 and the opposing surface of the foldover bar 65 are inclined at an angle A2 (FIG. 3) within a range of about 20 degrees and 25 degrees, or about 22 degrees which is essentially one half the angle A1 of the axis of the shaft 40 supporting the roll R of silt fence material F. As best shown in FIGS. 1 and 3, a flexible and resilient fence protector member or sheet rubber panel 75 projects rearwardly from the plow plate 55 and has a forward portion removably connected or secured to the inner side of the plow plate 55 by a series of fasteners or bolts 77. Preferably, the plow plate 55 has a thickness greater than the thickness of the foldover bar 65 which is positioned in the center of the plow plate 55, as shown in FIG. 2. The flexible panel 75 is positioned inwardly adjacent the inner surface of the fence material F which extends from the roll R directly to the gap 70 and around the foldover bar 65. The material F then extends rearwardly from the outer surface of the foldover bar 65 into a vertical slit formed in the ground by the plow plate 55, as shown in FIG. 3.

Figure 4:
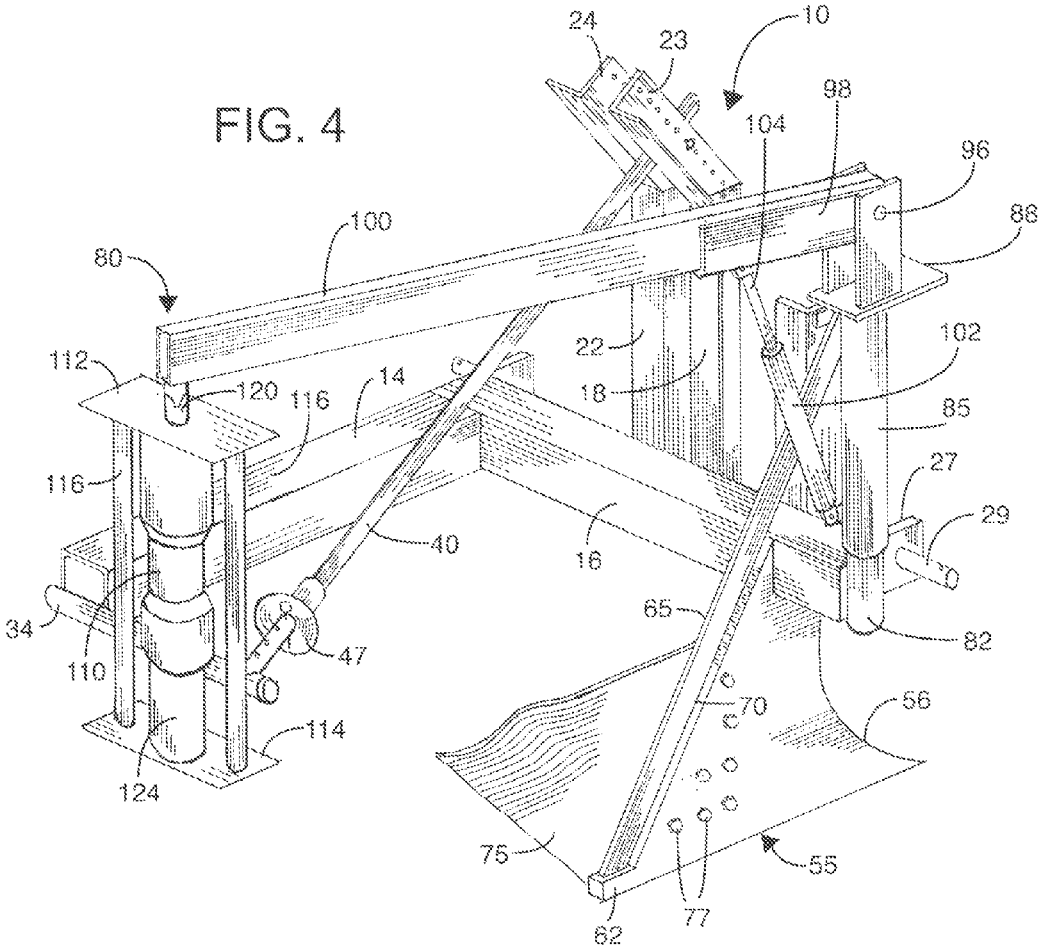
FIG. 4 is a perspective view of the apparatus and including a stake driving system.
Figure 5:
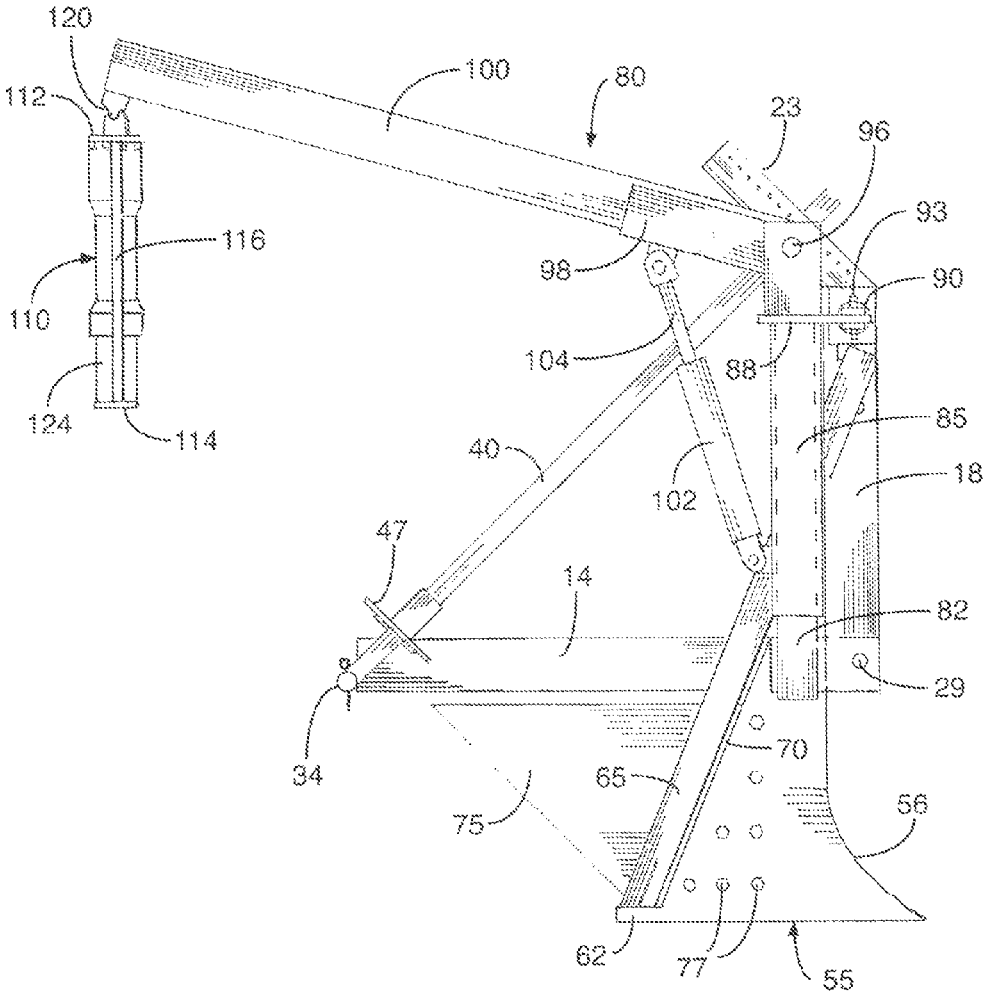
FIG. 5 is a side elevation view of the apparatus shown in FIG. 4

Referring to FIGS. 4 & 5, it is desirable to use the silt fence installing apparatus disclosed above in connection with FIGS. 1-3 in combination with apparatus for driving fence posts into the ground after a lower portion of the silt fence has been inserted into the ground and at longitudinally spaced intervals adjacent the vertical silt fence above the ground. Accordingly, FIGS. 4 & 5 disclose a post installing apparatus 80 similar to the apparatus disclosed in applicant's U.S. Pat. No. 7,296,636 and in combination with the silt fence inserting or installing apparatus 10 disclosed in FIGS. 1-3.

The post installing apparatus 80 includes a vertical cylindrical support mast 82 which is supported by the frame 12, for example, by welding the mast 82 to an end of the horizontal frame member 16 behind the right pivot pin 29. However, the mast 82 may also be supported by a frame member projecting rearwardly from the end of the frame members 16. The vertical support mast 82 supports a cylindrical and tubular mast extension 85 for rotation on a vertical axis, and a U-shape bracket 88 is secured to the top of the mast extension 85 and engages the top end surface of the support mast 82 within the mast extension 85. A horizontally extending double acting hydraulic cylinder 90 (FIG. 5) is pivotally connected to the vertical frame member 18 and has a piston rod pivotally connected to the bracket 88 by a vertical pivot pin 93. Actuation of the cylinder 90 is effective to rotate the mast extension 85 on the vertical mast 82 in opposite directions.

The U-shape bracket 88 supports a horizontal cross shaft or pin 96 which pivotally supports a channel member 98 receiving an end portion of an elongated boom 100 also pivotally supported by the cross pin 96 for pivotal movement of the channel member 98 and boom 100 on the horizontal axis of the cross pin 96. A double acting hydraulic cylinder 102 has a lower end portion pivotally connected to the mast extension 85 and a piston rod 104 pivotally connected to the bottom of the channel member 98.

The boom 100 has a rearward or outer end portion which supports a hydraulically actuated impact hammer or driver 110. The driver is positioned between an upper horizontal plate 112 and a lower horizontal plate 114, and the plates 112 and 114 are rigidly connected by a pair of vertical tie rods 116. The upper plate 112 is connected to the outer end portion of the boom 100 by a universal joint or coupling 120 so that the impact driver 110 freely depends vertically from the rearward end portion of the boom 100. The bottom plate 114 has a center hole which is surrounded by a tubular post socket or locator 124 which receives the upper end portion of a stake.

When it is desired to drive a stake into the ground, the boom 100 is pivoted upwardly by extension of the hydraulic cylinder 102 which simultaneously pivots the channel member 98 and the boom 100 to a position where an upper end portion of a stake may be inserted into the socket or locator 124 which holds the stake vertically. The boom 100 is moved laterally to position the stake adjacent the installed silt fence by actuation of the hydraulic cylinder 90 which rotates the boom 100. The boom 100 is then lowered by the cylinder 102 until the bottom end of the stake engages the ground when the vertical impact driver 110 is actuated to commence driving of the stake vertically into the ground. While driving the stake with the impact hammer or driver 110, the channel member 98 may be pivoted downwardly by actuation of the cylinder 102 so that the weight of the boom 100 cooperates with the weight of the impact driver 110 to drive the stake into the ground until the upper end of the stake is located at the desired height. The channel member 98 may then be pivoted upwardly by actuation of the cylinder 102 to pivot the boom 100 upwardly and move the impact driver 110 vertically upwardly for receiving the upper end portion of the next stake to be driven into the ground.

As mentioned above, the silt fence installing apparatus 10 of the invention provides desirable features and advantageous. As one advantage, the flexible and resilient protector member 75, such as a sheet rubber panel, provides for protecting the silt fence material as it is pulled through the narrow gap 70 by preventing stones and other debris or foreign objects imbedded in the ground from being pulled into the gap and thereby prevents ripping or tearing of the fence material. The panel 75 being flexible allows for tighter turns of the tractor or vehicle which is pulling the apparatus. The flexible panel 75 is also easily replaced, less costly than a rigid panel, and provides for easier threading of the silt fence material into the gap 70 and around the foldover bar 65. The flexible and resilient panel 75 also results in less maintenance for the apparatus and less wear on the panel when compared with a rigid metal panel.

Additional advantages are provided by the support of the roll R of silt fence or fabric material on the inclined support shaft 40 and the inclined foldover bar 65 which is positioned on an angle about one half of the angle of the roll support shaft 40. This arrangement provides for minimizing the horizontal length of the plow plate 55 and foldover bar 65 to minimize the turning radius of the vehicle. The acute angle A1 of the shaft 40 is also conveniently adjustable by adjusting the cross pin 43 within selected aligned holes 44 to obtain the optimum position of the roll R and to provide for convenient loading of a roll R onto the shaft 40 after the shaft is tilted to the rear. In addition, the axial adjustment of the roll R on the shaft 40 by axially positioning to core stop plate 47 on the shaft with the adjustment cross pin 48 and holes 49 also provides for accommodating irregularities in the winding of the material on the core and thereby provides for positioning the lower edge of the silt fence material F so that it feeds around the foldover bar 65 near the bottom of the foldover bar 65 and close to the bottom of the slit formed within the ground by the plow plate 55.

A further advantage of the apparatus is provided by combining the silt fence installing apparatus 10 with the stake driving and installing apparatus 80 shown in FIGS. 4 and 5. This compact and simplified combined apparatus provides for efficiently installing silt fence with the vertical support posts or stakes adjacent the fence so that the fence material may be quickly attached or stapled to the posts and thereby provide for more efficiently installing a silt fence having substantial length.

While the form of silt fence installing apparatus herein described constitutes a preferred embodiment of the invention, it is to be understood that the invention is not limited to this precise form of apparatus, and that changes may be made therein without departing from the scope and spirit of the invention as defined in the appended claims.

What is claimed is:

1. Apparatus for inserting into the ground a longitudinal edge portion of an elongated strip of flexible silt fence material extending from a supply roll, said apparatus comprising a frame including a connector for connecting said apparatus to a vehicle, said frame supporting a shaft having an axis and supporting a supply roll of said silt fence material, a vertical plow plate supported by said frame and having a forward edge surface and an inclined linear rearward edge surface, said frame and a lower portion of said plow plate supporting a foldover member, positioned behind said rearward edge surface of said plow plate and defining a gap between said foldover member and said rearward edge surface, said gap adapted to receive said silt fence material extending from said supply roll and for folding the material around said foldover member with an edge portion of the material extending into a slit formed into the ground by said plow plate in response to forward movement of said apparatus with the vehicle, a flexible and resilient elastomeric protector panel connected to said plow plate and projecting rearwardly from said rearward edge surface and positioned adjacent said silt fence material entering said gap and within the slit in the ground, and said protector panel being effective to block rocks and debris from entering said gap with said material and prevent disrupting the movement of the material through said gap.

2. Apparatus as defined in claim 1 wherein said axis of said shaft supporting said supply roll extends in a generally vertical plane generally parallel to said plow plate, and said shaft is inclined at an angle within a range of about forty degrees and fifty degrees.

3. Apparatus as defined in claim 1 wherein said inclined rearward edge surface of said plow plate and said inclined foldover member define said gap at an angle within a range of about twenty degrees and twenty five degrees.

4. Apparatus as defined in claim 3 wherein said inclined foldover member extends above said vertical plow plate.

5. Apparatus as defined in claim 2 wherein said frame supports said shaft for said supply roll for adjustable tilting movement relative to said foldover member to assure that an edge portion of said silt fence material runs continuously to a bottom portion of said foldover member.

6. Apparatus as defined in claim 5 wherein said shaft supporting said supply roll includes an axially adjustable end plate engaging a lower end of said supply roll to accommodate variations between a lower end of said supply roll and an end of a core member within said supply roll.

7. Apparatus as defined in claim 1 wherein said flexible and resilient protector panel is removably connected to a side surface of said plow plate.

8. Apparatus for inserting into the ground a longitudinal edge portion of an elongated strip of flexible silt fence material extending from a supply roll, said apparatus comprising a frame including a connector for connecting said apparatus to a vehicle, said frame supporting a shaft having an axis and supporting a supply roll of said silt fence material, a vertical plow plate supported by said frame and having a forward edge surface and an inclined linear rearward edge surface, said axis of said shaft supporting said supply roll with said shaft inclined at an angle within a range of about forty degrees and fifty degrees, said frame and a lower portion of said plow plate supporting opposite end portions of an inclined foldover member positioned behind said rearward edge surface of said plow plate and defining a gap between said foldover member and said rearward edge surface, said inclined rearward edge surface of said plow plate and said inclined foldover member defining a gap extending at an angle within a range of about twenty degrees and twenty five degrees, and said gap adapted to receive said silt fence material extending from said supply roll and for folding the material around said foldover member with an edge portion of the material extending into a slit formed into the ground by said plow plate in response to forward movement of said apparatus with the vehicle.

9. Apparatus as defined in claim 8 wherein said frame supports said shaft for said supply roll for adjustable tilting movement in said vertical plane and relative to said foldover member to assure that an edge portion of said silt fence material runs continuously near a bottom portion of said foldover member.

10. Apparatus as defined in claim 8 wherein said shaft supporting said supply roll includes an axially adjustable end plate engaging a lower end of said supply roll to accommodate variations between a lower end of said supply roll and a corresponding end of a core member within said supply roll.

11. Apparatus as defined in claim 8 and including a flexible and resilient protector member removably connected to a side surface of said plow plate and projecting rearwardly from said plow plate.

12. Apparatus for inserting into the ground a longitudinal edge portion of an elongated strip of flexible silt fence material extending from a supply roll and for inserting stakes adjacent the fence material, said apparatus comprising a frame including a connector for connecting said apparatus to a vehicle, said frame supporting a shaft having an axis and supporting a supply roll of said silt fence material, a vertical plow plate supported by said frame and having a forward edge surface and an inclined linear rearward edge surface, said frame and a lower portion of said plow plate supporting a foldover member, positioned behind said rearward edge surface of said plow plate and defining a gap between said foldover member and said rearward edge surface, said gap adapted to receive said silt fence material extending from said supply roll and for folding the material around said foldover member with an edge portion of the material extending into a slit formed into the ground by said plow plate in response to forward movement of said apparatus with the vehicle, a flexible and resilient elastomeric protector panel connected to said plow plate and projecting rearwardly from said rearward edge surface and positioned adjacent said silt fence material entering said gap and within the slit in the ground, said protector member being effective to block rocks and debris from entering said gap with said material and prevent disrupting the movement of the material through said gap, a stake driver supported by said frame and including a generally horizontal boom having one end portion supported for horizontal movement and vertical tilting movement of said boom, a hydraulic cylinder for moving said boom, and a hydraulically activated impact driver supported with a vertical axis by an opposite end portion of said boom.

13. Apparatus as defined in claim 12 wherein said axis of said shaft supporting said supply roll extends in a generally vertical plane generally parallel to said plow plate, and said shaft is inclined at an angle within a range of about forty degrees and fifty degrees.

14. Apparatus as defined in claim 13 wherein said frame supports said shaft for said supply roll for adjustable tilting movement relative to said foldover member to assure that an edge portion of said silt fence material runs continuously to a bottom portion of said foldover member.

15. Apparatus as defined in claim 14 wherein said shaft supporting said supply roll includes an axially adjustable end plate engaging a lower end of said supply roll to accommodate variations between a lower end of said supply roll and an end of a core member within said supply roll.

16. Apparatus for inserting into the ground a longitudinal edge portion of an elongated strip of flexible silt fence material extending from a supply roll and for inserting stakes adjacent the fence material, said apparatus comprising a frame including a connector for connecting said apparatus to a vehicle, said frame supporting a shaft having an axis and supporting a supply roll of said silt fence material, a vertical plow plate supported by said frame and having a forward edge surface and an inclined linear rearward edge surface, said axis of said shaft supporting said supply roll extending with said shaft inclined at an angle within a range of about forty degrees and fifty degrees, said frame and a lower portion of said plow plate supporting opposite end portions of an inclined foldover member positioned behind said rearward edge surface of said plow plate and defining a gap between said foldover member and said rearward edge surface, said inclined rearward edge surface of said plow plate and said inclined foldover member defining a gap extending at an angle within a range of about twenty degrees and twenty five degrees, said gap adapted to receive said silt fence material extending from said supply roll and for folding the material around said foldover member with an edge portion of the material extending into a slit formed into the ground by said plow plate in response to forward movement of said apparatus with the vehicle, a stake driver supported by said frame and including a generally horizontal boom having one end portion supported for horizontal movement and vertical tilting movement of said boom, a hydraulic cylinder for moving said boom, and a hydraulically activated impact driver supported with a vertical axis by an opposite end portion of said boom.

17. Apparatus as defined in claim 16 wherein said frame supports said shaft for said supply roll for adjustable tilting movement in said vertical plane and relative to said foldover member to assure that an edge portion of said silt fence material runs continuously near a bottom portion of said foldover member.

18. Apparatus as defined in claim 16 wherein said shaft supporting said supply roll includes an axially adjustable end plate engaging a lower end of said supply roll to accommodate variations between a lower end of said supply roll and a corresponding end of a core member within said supply roll.

* * * * *